US008135313B2

(12) United States Patent
Yoshida et al.

(10) Patent No.: US 8,135,313 B2
(45) Date of Patent: Mar. 13, 2012

(54) POWDER TRANSPORT SCREW, AND DEVELOPMENT DEVICE, PROCESS UNIT AND IMAGE-FORMING APPARATUS COMPRISING THIS POWDER TRANSPORT SCREW

(75) Inventors: Tomofumi Yoshida, Osaka (JP); Hirobumi Ooyoshi, Osaka (JP); Kenzo Tatsumi, Osaka (JP); Tomohiro Kubota, Osaka (JP); Yoshiyuki Shimizu, Hyogo (JP); Yoshihiro Kawakami, Hyogo (JP); Osamu Saito, Osaka (JP); Manabu Hamada, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 379 days.

(21) Appl. No.: 12/338,366

(22) Filed: Dec. 18, 2008

(65) Prior Publication Data

US 2009/0169265 A1 Jul. 2, 2009

(30) Foreign Application Priority Data

Dec. 28, 2007 (JP) ..... 2007-339835

(51) Int. Cl.
*G03G 15/08* (2006.01)

(52) U.S. Cl. ..... 399/256

(58) Field of Classification Search ..... 399/254, 399/256, 258, 263
See application file for complete search history.

(56) References Cited

U.S. PATENT DOCUMENTS

| | | | | |
|---|---|---|---|---|
| 5,355,199 | A * | 10/1994 | Bray | 399/256 |
| 5,659,859 | A * | 8/1997 | Kikuta et al. | 399/256 |
| 5,812,916 | A * | 9/1998 | Kishimoto et al. | 399/263 |
| 7,835,672 | B2 * | 11/2010 | Sakamoto et al. | 399/254 |
| 7,881,638 | B2 * | 2/2011 | Noguchi et al. | 399/254 |
| 2007/0104523 | A1 | 5/2007 | Yoshida et al. | |
| 2008/0089727 | A1 | 4/2008 | Shimizu et al. | |
| 2008/0095559 | A1 | 4/2008 | Shimizu et al. | |
| 2008/0145108 | A1 | 6/2008 | Yoshida et al. | |
| 2008/0145109 | A1 | 6/2008 | Murayama et al. | |
| 2008/0170898 | A1 | 7/2008 | Shimizu et al. | |

FOREIGN PATENT DOCUMENTS

| | | | |
|---|---|---|---|
| JP | 07271188 | A * | 10/1995 |
| JP | 08062957 | A * | 3/1996 |
| JP | 3851530 | | 9/2006 |

* cited by examiner

*Primary Examiner* — Robert Beatty
(74) *Attorney, Agent, or Firm* — Oblon, Spivak, McClelland, Maier & Neustadt, L.L.P.

(57) ABSTRACT

A toner transport screw that is capable of maintaining a smooth and stable transport function. The toner transport screw, in which a helical blade is disposed on the circumference of a rotating shaft, has at least one spiral direction reversal part formed by connecting the respective ends of a first blade part and a second blade part, the directions of spiral of the first blade part and the second blade part being in opposite directions. A passage, which allows the toner to pass through the blades in the circumferential direction of the rotating shaft, is formed in the spiral direction reversal part.

17 Claims, 14 Drawing Sheets

FIG. 9

| h (mm) | 0 | 0.5 | 1 | 3 | 5 | 6 | 7.5 | 10 | 12 |
|---|---|---|---|---|---|---|---|---|---|
| TONER CLOGGING | × | △ | ○ | ○ | ○ | ○ | ○ | ○ | ○ |
| TONER TRANSPORT FORCE ORTHOGONAL TO AXIAL DIRECTION OF SCREW | ○ | ○ | ○ | ○ | ○ | △ | △ | × | × |

FIG. 10

| h/d | 0 | 0.1 | 0.25 | 0.5 | 1 | 1.25 | 1.5 | 2 | 4 |
|---|---|---|---|---|---|---|---|---|---|
| TONER CLOGGING | × | △ | ○ | ○ | ○ | ○ | ○ | ○ | ○ |
| TONER TRANSPORT FORCE ORTHOGONAL TO AXIAL DIRECTION OF SCREW | ○ | ○ | ○ | ○ | ○ | ○ | △ | △ | × |

FIG. 11

| 2h/(ϕ-d) | 0 | 0.25 | 0.5 | 1 | 2.5 | 5 | 7.5 | 10 | 12 |
|---|---|---|---|---|---|---|---|---|---|
| TONER CLOGGING | × | △ | ○ | ○ | ○ | ○ | ○ | ○ | ○ |
| TONER TRANSPORT FORCE ORTHOGONAL TO AXIAL DIRECTION OF SCREW | ○ | ○ | ○ | ○ | ○ | △ | △ | × | × |

| θ | −150° | −120° | −90° | −45° | −30° | 0° | 30° | 45° | 90° | 120° | 150° | 180° |
|---|---|---|---|---|---|---|---|---|---|---|---|---|
| TONER TRANSPORT FORCE ORTHOGONAL TO AXIAL DIRECTION OF SCREW | △ | △ | △ | △ | ○ | ○ | ○ | △ | △ | △ | △ | × |

POWDER TRANSPORT SCREW, AND DEVELOPMENT DEVICE, PROCESS UNIT AND IMAGE-FORMING APPARATUS COMPRISING THIS POWDER TRANSPORT SCREW

BACKGROUND OF THE INVENTION

1. Field of the Invention

The present invention relates to a powder transport screw for transporting a toner and other such powder, and a development device, process unit and image-forming apparatus comprising this powder transporting screw.

Furthermore, a spiral direction reversal part of this transport screw is constituted by connecting together blade parts that spiral in opposite directions from one another, and a V-shaped groove is formed at the connection portion of the blade part and the blade part. When toner enters into this V-shaped groove, it can be hard for the toner to detach from this groove. Then, when toner that has entered inside the V-shaped groove deteriorates, the fluidity of this toner decreases, and the toner clumps together inside the groove. The build up of toner resulting from the clumped toner causes problems, such as a reduction in the transporting function of the transport screw, and the clogging of the transport route.

Further, this clumping and accumulation of the toner inside the groove can also occur in the spiral direction reversal part, which carries the toner out toward both ends of the transport screw in the axial direction, but is more apt to occur in the spiral direction reversal part that carries the toner in from both ends of the transport screw due to the toner density becoming higher.

2. Description of the Related Art

A copier, printer, facsimile machine or an image-forming apparatus that is a composite of these, for example, comprises a transport screw like that shown in Japanese Patent Application Laid-open No. 2003-107828 as transporting means for transporting a toner. A portion, where the direction of the spiral of this helical blade reverses, is disposed part way along this transport screw. Rotating this transport screw in one direction transports the toner from the portion where the direction of the spiral is reversed (hereinafter referred to as the spiral direction reversal part) toward both ends of the transport screw in the axial direction. Further, rotating this transport screw in the opposite direction makes it possible to transport toner from both ends of the transport screw in the axial direction toward the spiral direction reversal part.

Technologies relating to the present invention are also disclosed in, e.g., Japanese Patent No. 3,851,530.

SUMMARY OF THE INVENTION

With the foregoing in view, it is an object of the present invention to provide a powder transport screw, which is capable of maintaining smooth and stable transporting functions, and a development device, process unit and image-forming apparatus that comprise this powder transport screw.

In an aspect of the present invention, a powder transport screw comprises a rotating shaft; helical blades comprising a first blade part and a second blade part disposed on the circumference of the rotating shaft, the directions of spiral of the first blade part and the second blade part being in opposite directions; at least one spiral direction reversal part formed by connecting the respective ends of the first blade part and the second blade part; and a passage that is formed in the spiral direction reversal part and that allows a powder to pass through the blade in the circumferential direction of the rotating shaft.

In another aspect of the present invention, a development device comprises a development part; a toner hopper for holding a toner supplied to the development part; and a toner transport screw disposed inside the development part. The toner transport screw comprises a rotating shaft; helical blades comprising a first blade part and a second blade part disposed on the circumference of the rotating shaft, the directions of spiral of the first blade part and the second blade part being in opposite directions; at least one spiral direction reversal part formed by connecting the respective ends of the first blade part and the second blade part; and a passage that is formed in the spiral direction reversal part and that allows the toner to pass through the blade in the circumferential direction of the rotating shaft.

In another aspect of the present invention, an image-forming apparatus comprises a toner transport screw. The toner transport screw comprises a rotating shaft; helical blades comprising a first blade part and a second blade part disposed on the circumference of the rotating shaft, the directions of spiral of the first blade part and the second blade part being in opposite directions; at least one spiral direction reversal part formed by connecting the respective ends of the first blade part and the second blade part; and a passage that is formed in the spiral direction reversal part and that allows the toner to pass through the blade in the circumferential direction of the rotating shaft.

BRIEF DESCRIPTION OF THE DRAWINGS

The above and other objects, features and advantages of the present invention will become more apparent from the following detailed description taken with the accompanying drawings in which:

FIG. 9 is a diagram showing the results by the test device for examining the appropriate range for the width of a transport route;

FIG. 10 is a diagram showing the results of an examination of the relationship between the width of the transport route and the diameter of the rotating shaft;

FIG. 11 is a diagram showing the results of an examination of the relationship between the width of the transport route, the diameter of the rotating shaft and the outside diameter of the blade;

DESCRIPTION OF THE PREFERRED EMBODIMENT(s)

Before explaining the present invention, the transport screw of the prior art disclosed in the above-mentioned Japan Patent Application Laid-open No. 2003-107828 will be explained by referring to a figure.

Figure 1:
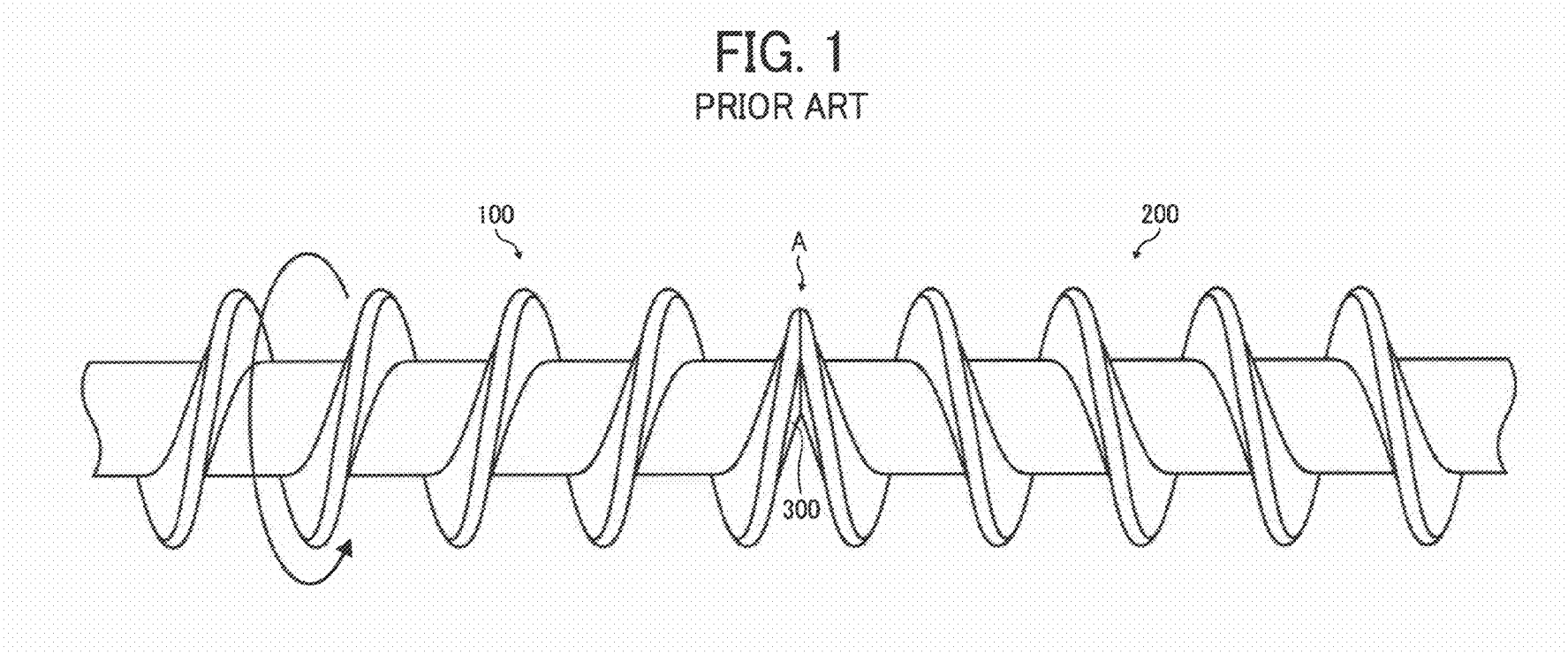
FIG. 1 PRIOR ART
FIG. 1 is a diagram showing the constitution of a feature of a conventional transport screw.

As shown in FIG. 1, the spiral direction reversal part A of this prior art transport screw is constituted by connecting together blade parts 100, 200 that spiral in opposite directions from one another. A V-shaped groove 300 is formed at the connection portion of blade part 100 and blade part 200. When toner enters into this V-shaped groove 300, the toner can have a hard time getting out of this groove 300. Then, when toner, which has entered inside the V-shaped groove 300 as described hereinabove, deteriorates, the fluidity of this toner decreases, and the toner clumps together inside the groove 300. The build up of toner resulting from the clumped toner causes problems, such as a reduction in the transporting function of the transport screw and the clogging of the transport route.

Further, this clumping and accumulation of the toner inside the above-mentioned groove 300 can also occur in the spiral direction reversal part, which carries the toner out toward both ends of the transport screw in the axial direction, but, due to the higher toner density involved, is especially apt to occur in the spiral direction reversal part that carries the toner in from both ends of the transport screw.

The present invention, which solves for such problems of the prior art transport screw, will be explained in detail hereinbelow by referring to the figures.

Figure 2:
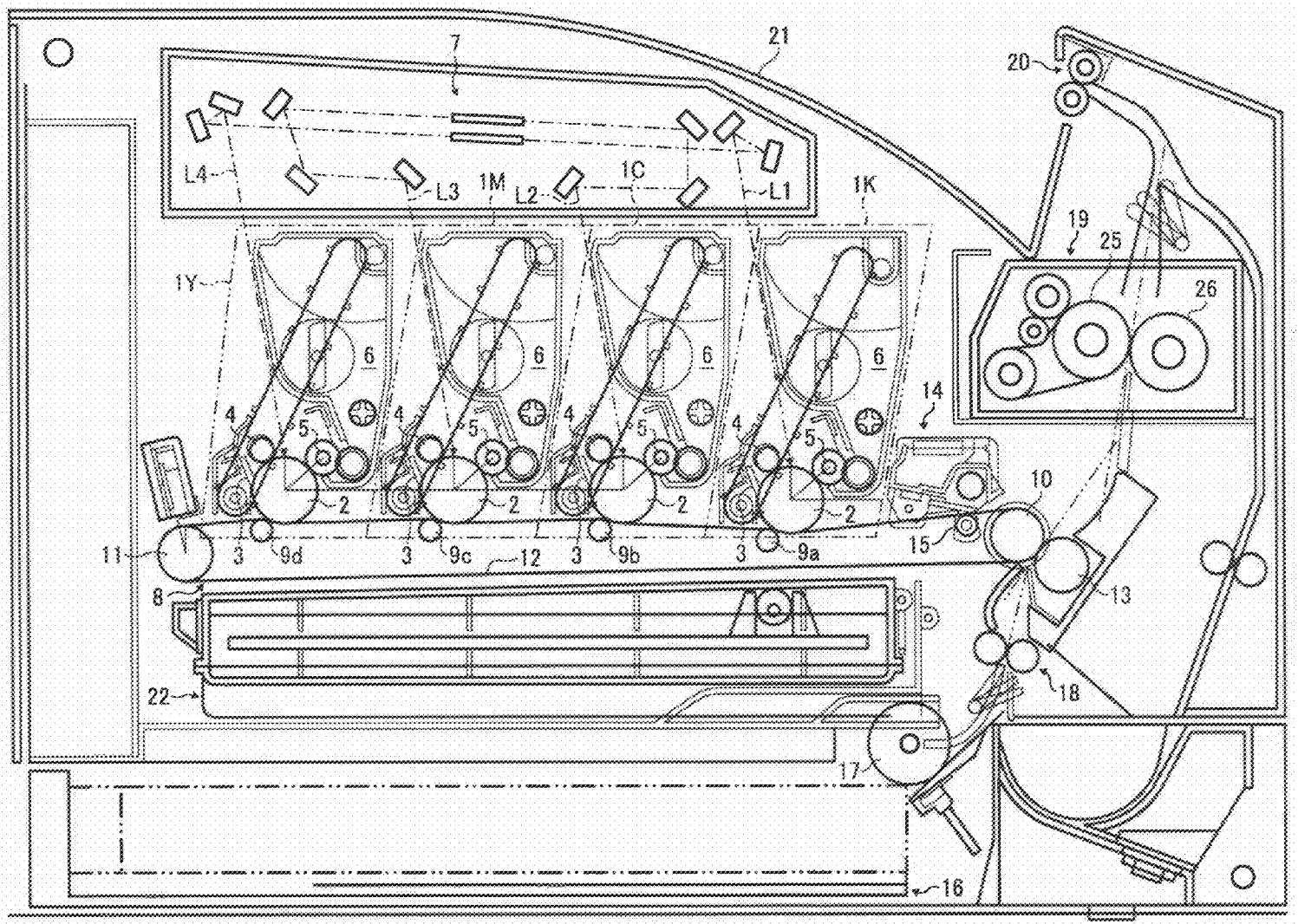
FIG. 2 is a diagram showing the constitution of the entire image-forming apparatus of the present invention.

FIG. 2 shows a simplified constitution of the entire image-forming apparatus in which the present invention is applied. The main parts of this image-forming apparatus will be explained below on the basis of this figure.

The image-forming apparatus comprises four process units 1K, 1C, 1M, and 1Y, which each have an image creation part for forming an image using the different colored developers black, cyan, magenta and yellow that correspond to the color separation components of a color image.

Outside of storing mutually different colored toners, the respective process units 1K, 1C, 1M, 1Y have the same constitution. This constitution will be explained taking one process unit 1K as an example. The process unit 1K has an image-bearing member 2, cleaning means 3, electrical charging means 4, developing means 5, and a toner hopper part 6. The process unit 1K is detachably mounted to the main unit of the image-forming apparatus.

An exposure device 7 is disposed above the process units 1K, 1C, 1M, 1Y. This exposure device 7 is constituted so as to emit laser beams (L1 through L4) from laser diodes on the basis of image data.

Further, a transfer belt device 8 is disposed below the process units 1K, 1C, 1M, 1Y. This transfer belt device 8 comprises an intermediate transfer belt 12 for transferring a toner image formed on the above-mentioned image-bearing member 2. The intermediate transfer belt 12 is constituted by being suspended around and rotationally driven by four primary transfer rollers 9*a*, 9*b*, 9*c*, 9*d*, each facing the image-bearing member 2, a drive roller 10, a tension roller 11, and a cleaning backup roller 15. A secondary transfer roller 13 is disposed facing the drive roller 10, and a belt cleaning device 14 is disposed facing the cleaning backup roller 15.

A paper feeding cassette 16, which is capable of holding a large number of sheets of paper, and a paper feeding roller 17, which feeds out a sheet of paper from the paper feeding cassette 16, are disposed in the bottom part of the image-forming apparatus. A pair of resistance rollers 18, which cause a sheet of paper to stop one time, is disposed part way between the paper feeding roller 17 and the nip of the secondary transfer roller 13 and the drive roller 10.

A fixing device 19, which is equipped with a built-in fixing roller 25 and pressure roller 26, is disposed above the nip of the secondary transfer roller 13 and the drive roller 10. A pair of paper discharge rollers 20 for ejecting a sheet of paper to the outside is disposed above the fixing device 19. The constitution is such that sheets of paper that have been ejected by the pair of paper discharge rollers 20 are loaded onto a catch tray 21, which is formed by recessing the top surface of the image-forming apparatus main unit toward the inner side.

A waste toner receptacle 22 for storing waste toner is disposed between the transfer belt device 8 and the paper feeding cassette 16. A not-shown waste toner removal hose, which extends from the belt cleaning device 14, is connected to the inlet part of the waste toner receptacle 22.

The basic operation of the above-described image-forming apparatus will be explained hereinbelow by referring to FIG. 2.

When the paper feeding roller 17 rotates in response to a paper feed signal from a not-shown controller of the image-forming apparatus, only the topmost sheet of paper of the paper loaded into the paper feeding cassette 16 is separated and fed out toward the pair of resistance rollers 18. When the edge of the sheet of paper reaches the nip of the pair of resistance rollers 18, the pair of resistance rollers 18 cause the sheet of paper to wait so as to coincide (synchronize) with the timing of a toner image formed on the intermediate transfer belt 12.

Next, an image creation operation will be explained.

An image creation operation will be explained using one of the process units 1K as an example. First, electrical charging means 4 charges the surface of the image-bearing member 2 to a uniform high potential. On the basis of image data, a laser beam L1 is irradiated onto the surface of the image-bearing member 2 from the exposure device 7, reducing the potential of the irradiated portion and forming an electrostatic latent image. Developing means 5 transfers toner supplied from the toner hopper 6 to the portion of the surface of the image-bearing member 2 on which the electrostatic latent image has been formed, forming (developing) a black toner image. Then, the toner imager formed on the image-bearing member 2 is transferred to the intermediate transfer belt 12. Toner images are similarly formed on the image-bearing members 2 of the other color process units 1C, 1M, 1Y, and transferred to the intermediate transfer belt 12 such that the toner images of the four colors are superimposed on one another.

Further, the respective cleaning means 3 remove the residual toner adhering to the surfaces of the image-bearing members 2 subsequent to the intermediate transfer processes. Thereafter, not-shown neutralization devices neutralize the residual charges of the image-bearing members 2 subsequent to cleaning.

The pair of resistance roller 18 and the paper feeding roller 17 resume driving, and a sheet of paper is sent to the secondary transfer roller 13 at a timing that coincides (is synchronized) with the toner image that has been superposedly transferred to the intermediate transfer belt 12. Then, the secondary transfer roller 13 transfers the superposedly transferred toner image to the sheet of paper that has been supplied.

The sheet of paper onto which the toner image has been transferred is transported toward the fixing device 19. The sheet of paper, which has been fed into the fixing device 19, is sandwiched between the fixing roller 25 and the pressure roller 26, and this unfixed toner image is subjected to heat and pressure and affixed to the sheet of paper. The sheet of paper on which the toner image has been affixed is sent out of the fixing device 19 toward the pair of paper discharge rollers 20, and ejected into the catch tray 21 by the pair of paper discharge rollers 20.

Further, after the toner image on the intermediate transfer belt 12 has been transferred to the sheet of paper, residual toner adheres to the intermediate transfer belt 12, and this residual toner is removed from the intermediate transfer belt 12 by the belt cleaning device 14. The toner that has been removed from the intermediate transfer belt 12 is transported to a powder receptacle 22 by a not-shown waste toner transporting means and recovered.

The constitution of a feature of the above-described image-formed apparatus will be explained hereinbelow.

Figure 3:
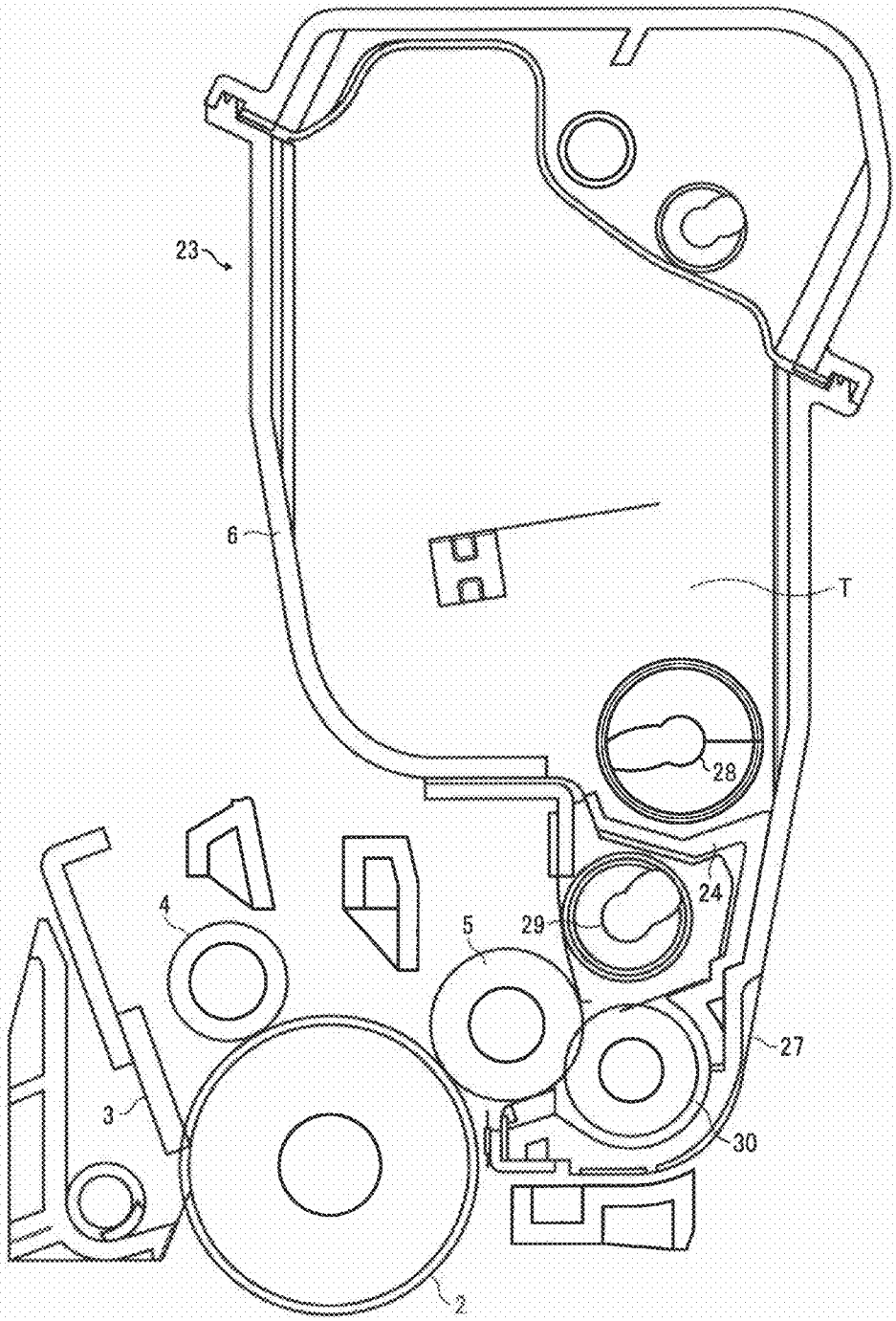
FIG. 3 is a cross-sectional view of a process unit of the present invention as seen from the side.

FIG. 3 shows a cross-sectional view of a process unit as seen from the side. The process unit has an enclosure 23 made from plastic. The toner hopper 6, which holds the toner T, is disposed in the upper part of this enclosure 23 in the figure. A development part 27, in which a development roller is installed as the above-mentioned developing means 5, is disposed beneath the toner hopper 6 by way of a partitioning member 24.

In the bottom part of the inside of the toner hopper 6, a toner feeding screw 28 is installed as toner feeding means for stirring and transporting the stored toner T. Furthermore, a transport coil or the like can also be used as toner feeding means inside this toner hopper 6.

In the development part 27, there are disposed a toner transport screw 29 that stirs and transports the toner inside the development part 27, and a supply roller 30 that supplies the toner to development means 5 (the development roller).

Figure 4:
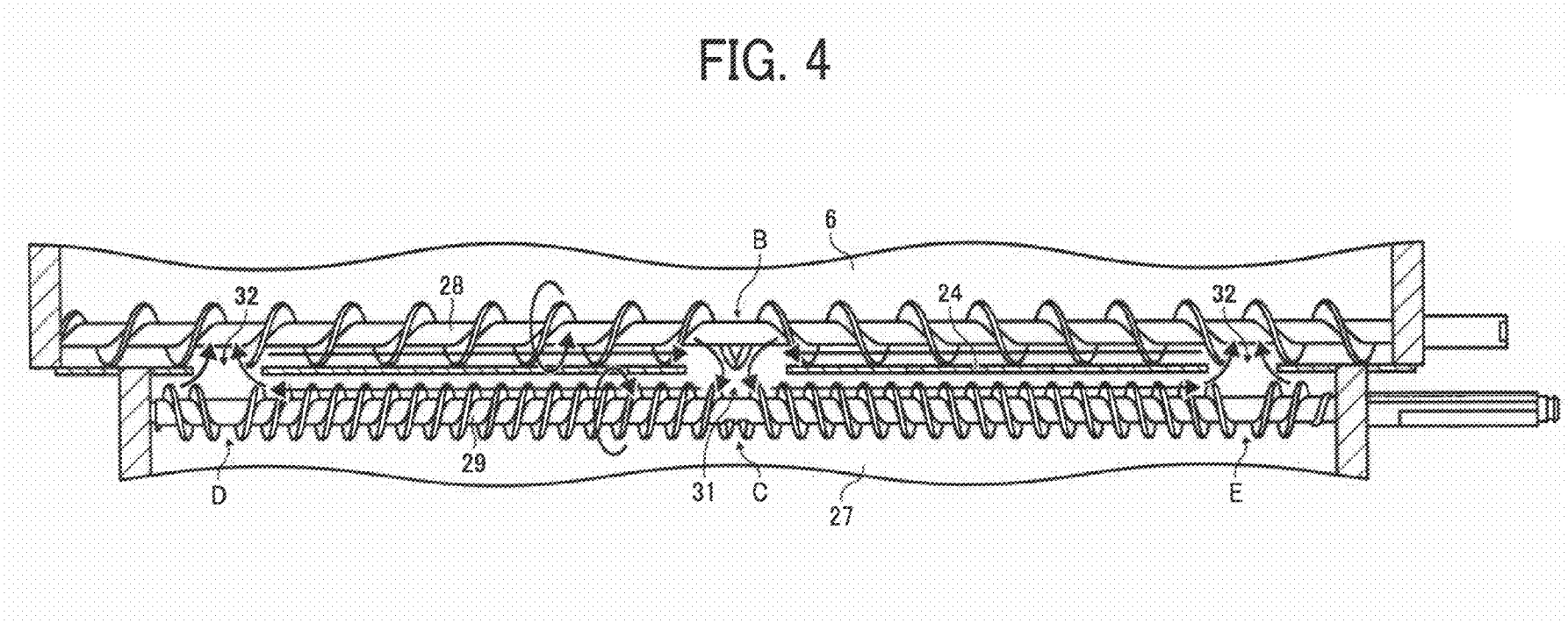
FIG. 4 is a front cross-sectional view showing the constitution of a feature of the above-mentioned process unit.

FIG. 4 is a cross-sectional view of the vicinity of the boundary between the above-mentioned toner hopper 6 and the development part 27 as seen from the front. As shown in FIG. 4, a supply opening 31 for supplying toner from the toner hopper 6 to the development part 27 is formed in the middle part of the partitioning member 24. Further, return openings 32 for returning the toner from the development part 27 to the toner hopper 6 are respectively formed near both ends of the partitioning member 24.

The direction of spiral of the blade of the toner feeding screw 28, which is installed above the partitioning member 24, reverses at a middle part in the axial direction thereof. Further, the portion B where the direction of spiral of the blade of this toner feeding screw 28 reverses is disposed corresponding to the supply opening 31 of the partitioning member 24. Hereinafter, the portion where the direction of spiral of the blade reverses will be called the spiral direction reversal part.

Meanwhile, spiral direction reversal parts C, D, E, where the direction of spiral of the blade reverses, are disposed in the axial direction at three locations, the middle part and the two ends, of the toner transport screw 29, which is installed below the partitioning member 24. Further, these spiral direction reversal parts C, D, E are respectively disposed corresponding to the supply opening 31 of the middle part and the return openings 32 of the two ends of the partitioning member 24.

The transport operations of the above-mentioned toner feeding screw 28 and toner transport screw 29 will be explained.

As shown in FIG. 4, rotating the toner feeding screw 28 in the direction of the arrow in the figure transports the toner inside the toner hopper 6 from both ends of the toner feeding screw 28 in the axial direction toward the spiral direction reversal part B of the middle part of the toner feeding screw 28. Then, the toner that has been transported to the spiral direction reversal part B is supplied to the development part 27 therebelow from the supply opening 31 in accordance with the dead weight thereof.

Further, in the development part 27, rotating the toner transport screw 29 in the direction of the arrow in the figure transports the toner supplied via the supply opening 31 from the spiral direction reversal part C of the middle part of the toner transport screw 29 to the spiral direction reversal parts D, E at the two ends in the axial direction. The toner inside the development part 27 is respectively transported toward the locations of the spiral direction reversal parts D and E by the blade parts further toward the ends of the toner transport screw 29 than the spiral direction reversal parts D, E of the two ends of the toner transport screw 29. That is, toner is carried in from both directions and accumulates in the spiral direction reversal parts D, E at the two ends of the toner transport screw 29.

Figure 5:
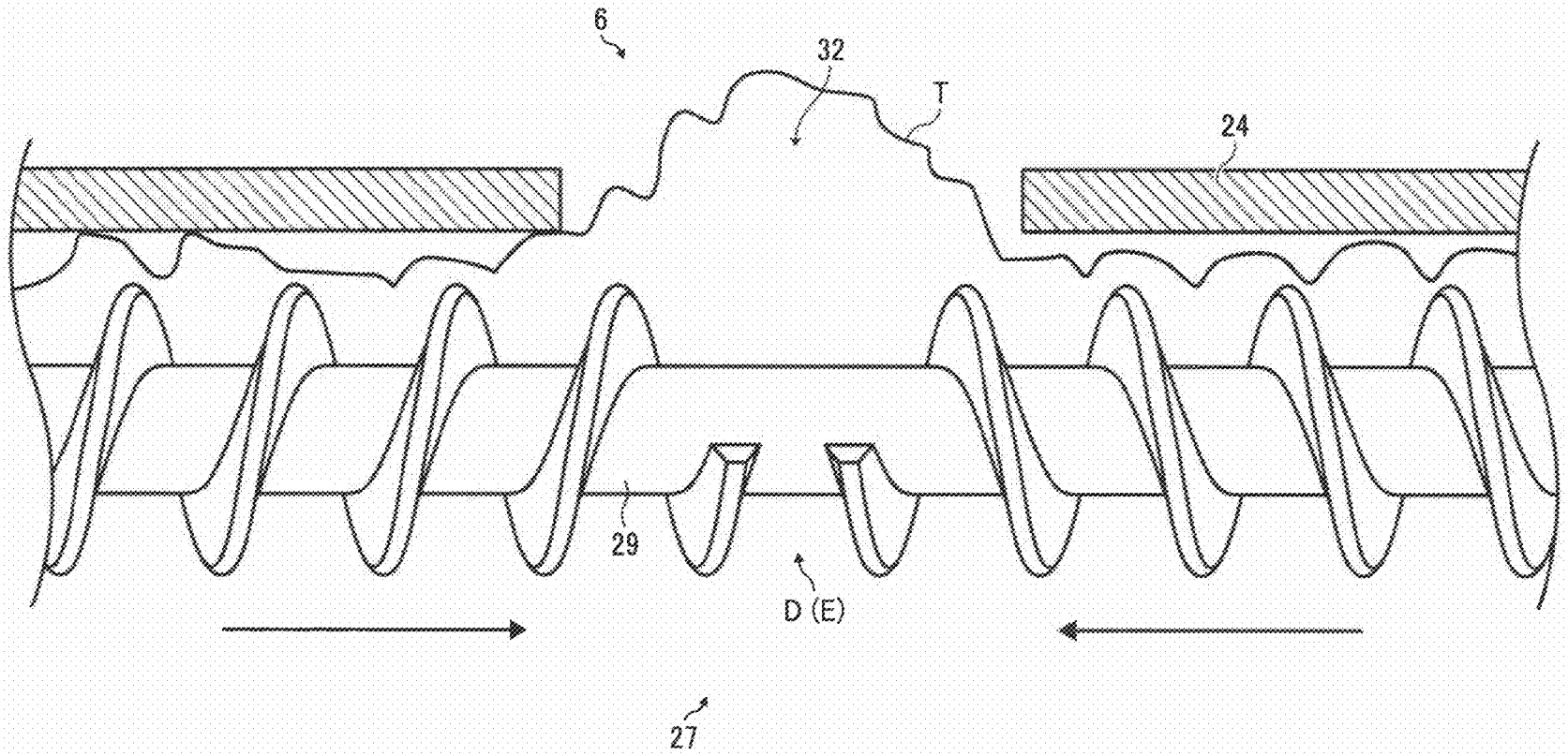
FIG. 5 is a diagram showing an enlarged view of the constitution of the feature of FIG. 4.

FIG. 5 is an enlarged view of either spiral direction reversal part D or E at the end of the toner transport screw 29. As shown in FIG. 5, toner is carried in from both directions and accumulates in the above-mentioned spiral direction reversal parts D, E, and the toner T is pushed upwards. The pushed up toner T is returned to the inside of the toner hopper 6 via the return openings 32. The toner is stirred and circulated between the toner hopper 6 and the development part 27 like this by the above-mentioned toner feeding screw 28 and the toner transport screw 29.

The characteristic part of the present invention will be explained hereinbelow.

Figure 6:
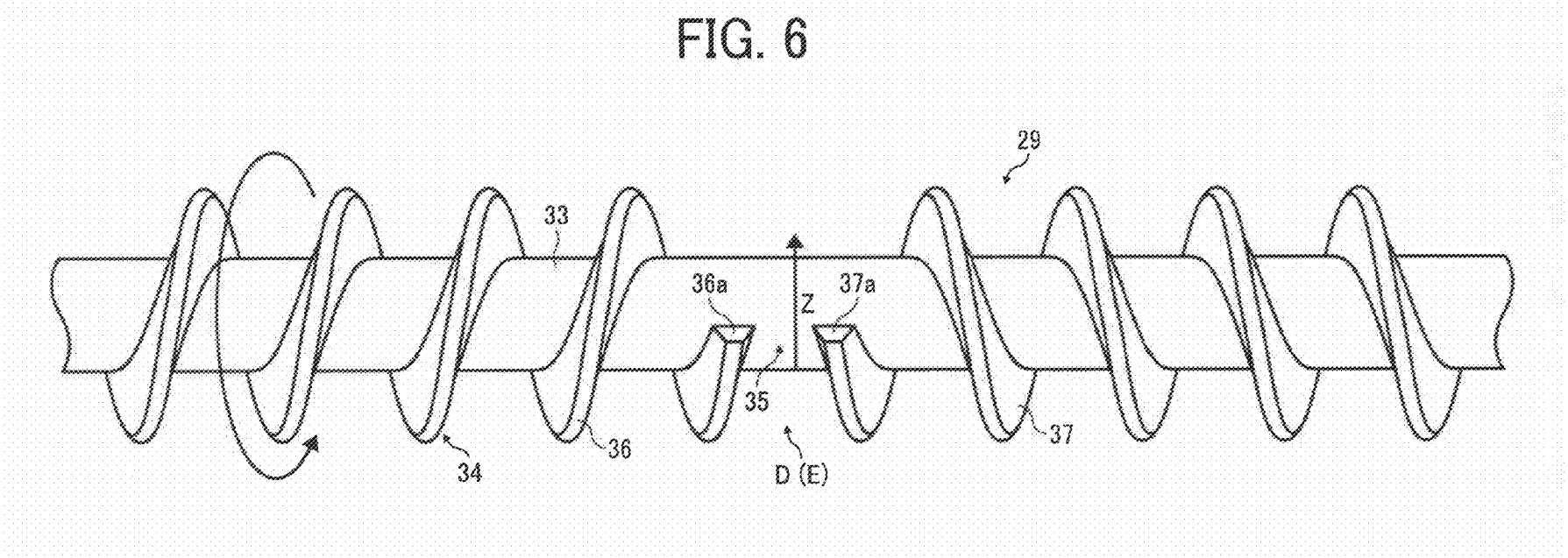
FIG. 6 is a diagram showing an enlarged view of the constitution of the feature of a transport screw of the present invention.

FIG. 6 shows either spiral direction reversal part D or E at the end of the toner transport screw 29 disposed inside the development part. Since these spiral direction reversal parts D and E at the ends of the toner transport screw 29 are constituted the same, the following explanation will use the constitution of the one spiral direction reversal part D as an example.

A passage 35 that allows toner to pass through in the circumferential direction of the rotating shaft 33 relative to the blade 34 is formed in the spiral direction reversal part D at the end of the transport screw of the present invention.

In FIG. 6, if we call the part of the blade 34 on the left side of the spiral direction reversal part D the first blade part 36, and the part of the blade 34 on the right side of the spiral direction reversal part D the second blade part 37, the first blade part 36 and the second blade part 37 are disposed completely separated from each other in the axial direction. The above-mentioned passage 35 is formed between the end 36*a* of the first blade part 36 and the end 37*a* of the second blade part 37, which are separated from one another.

Furthermore, in the present invention, the above-mentioned "spiral direction reversal part" refers to either the portion where the ends of the two blade parts, which spiral in opposite directions from one another, are connected, or to the portions arranged in approximation to the ends of the two blade parts, which spiral in opposite directions from one another as shown in FIG. 6.

The toner transport screw 29 shown in FIG. 6 is constituted such that the blades of the spiral direction reversal part of the prior art toner transport screw shown in FIG. 1 are removed across a prescribed range in the axial direction. Further, it is also possible to form a passage 35 (drawing omitted) by a method that either makes a notch or forms a hole in the blades of the spiral direction reversal part of the prior art toner transport screw. That is, one part of the end 36*a* of the first blade part 36 and one part of the end 37*a* of the second blade part 37 can be connected.

Figure 7:
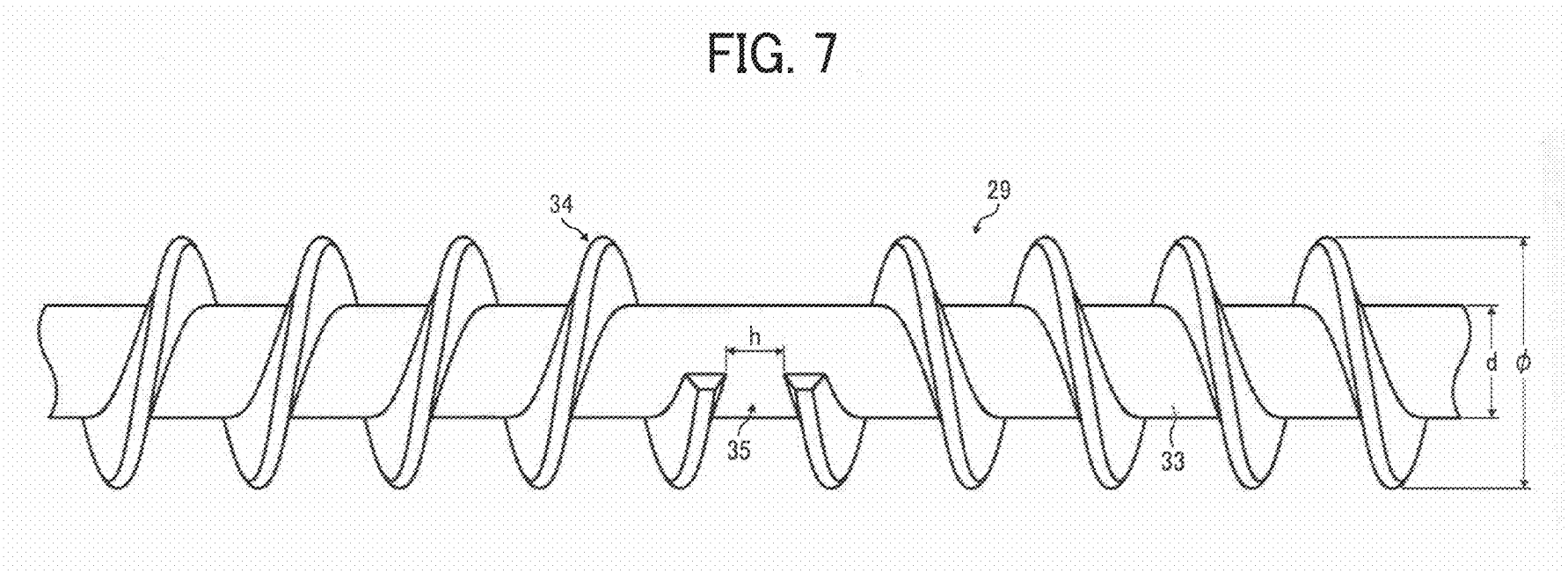
FIG. 7 is a diagram showing the respective dimensions of the above-mentioned transport screw.

It is conceivable that if the width h of the passage 35 in the axial direction shown in FIG. 7 is too small, the toner will have difficulty passing through the passage 35, raising concerns that clogging will occur. Further, by contrast, if the above-mentioned width h of the passage 35 is too large, there is the fear that toner transport force orthogonal to the axial direction at the spiral direction reversal part, that is, the ability to push the toner up will decrease, giving rise to the problem of the toner not being able to return to the toner hopper 6. Therefore, the width h of the passage 35 should not be too small or too large, and must be set within an appropriate range.

Accordingly, the eight inventors of the present invention carried out tests to determine the appropriate range of the width h of the above-mentioned passage 35.

Figure 8:
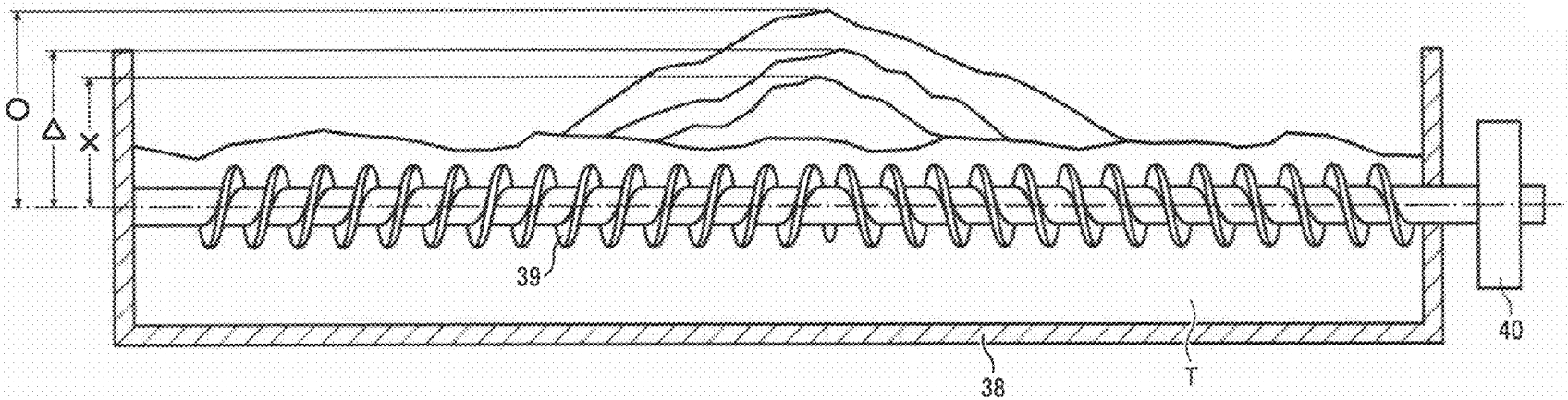
FIG. 8 is a diagram showing a simplified constitution of a test device for examining the appropriate range for the width of a transport route.

As shown in FIG. 8, a toner transport screw 39, which forms a passage 35 (drawing omitted) in the middle part in the axial direction, was buried in toner T held in a container 38, and a drive motor 40 was attached to one end of the toner transport screw 39, which was exposed outside of the container 38. Then, the toner transport screw 39 was rotated for a prescribed period of time by driving the drive motor 40. The degree of toner clogging and the toner transport force orthogonal to the axial direction of the screw (toner push-up force) were examined for respective values of the width h of the passage 35 at the time. The results of these determinations are shown in FIG. 9.

The results shown in FIG. 9 will be explained. An × is used to show that toner clogging occurred in the middle stages of toner deterioration, and a Δ is used to show that toner clogging occurred at the final stage of toner deterioration. Further, a ○ is used to show that toner clogging did not occur. Furthermore, a passage 35 width h of 0 signifies that a passage 35 was not formed at the spiral direction reversal part of the toner transport screw. Based on the results, it is preferable that the lower limit value of the width h be set at 1 mm in order to fully achieve the toner passage function of the passage 35 and prevent toner clogging.

With regard to the toner transport force orthogonal to the axial direction of the screw of FIG. 9, as shown in FIG. 8, a ○ is used when the toner push-up height is the highest, and, by contrast, an × is used when this toner push-up height is the lowest. The Δ is used when the toner push-up height is a height between the above-mentioned highest and lowest heights. Based on these results, it is preferable that the upper limit value of the width h be set to 5 mm to obtain good toner transport force orthogonal to the axial direction of the screw (toner push-up force).

Based on the results of the tests described hereinabove, the appropriate range of the width h of the passage 35 can be said to be 1 mm≦h≦5 mm. Further, taking into account variations in the above measurement results resulting from various factors, the optimum value of the width h is considered to be 3 mm, the central value of the above-mentioned appropriate range.

Further, the inventors conducted tests to determine the relationship between the width h of the passage 35 and the diameter d of the rotating shaft 33 (refer to FIG. 7). The test methodology is the same as that for the tests explained using FIG. 8. The relationship between the width h of the passage 35 and the diameter d of the rotating shaft 33 is treated as h/d, and the determination results of the degree of toner clogging in the passage 35 and the toner transport force orthogonal to the axial direction of the screw (toner push-up force) of respective values for this h/d are shown in FIG. 10.

The ○, Δ and × in FIG. 10 have the same meanings as in FIG. 9. Based on the results shown in this FIG. 10, it is preferable that the lower limit value of h/d be set at 0.25 to prevent toner clogging. Further, it is preferable that the upper limit value of h/d be set at 1.25 to obtain good toner transport force orthogonal to the axial direction of the screw (toner push-up force).

Therefore, the appropriate range of the value of h/d can be said to be 0.25≦h/d≦1.25 (or 0.25×d≦h≦1.25×d). Further, taking into account variations in the above measurement results due to various factors, the optimum value of h/d is considered to be 0.75, the central value of the above-mentioned appropriate range.

In addition, tests were conducted to determine the relationship between the width h of the passage 35, the diameter d of the rotating shaft 33 and the outside diameter ϕ of the blade 34 (refer to FIG. 7). The test methodology is the same as that for the tests explained using FIG. 8. The relationship between the width h of the passage 35, the diameter d of the rotating shaft 33 and the outside diameter ϕ of the blade 34 is expressed as 2h/(ϕ−d), and the determination results of the degree of toner clogging in the passage 35 and the toner transport force orthogonal to the axial direction of the screw (toner push-up force) for respective values of this 2h/(ϕ−d) are shown in FIG. 11.

The ○, Δ and × in FIG. 11 have the same meanings as in FIG. 9. Based on the results shown in this FIG. 11, it is preferable that the lower limit value of 2h/(ϕ−d) be set at 0.5 to prevent toner clogging. Further, it is preferable that the upper limit value of 2h/(ϕ−d) be set at 2.5 to obtain good toner transport force orthogonal to the axial direction of the screw (toner push-up force).

Therefore, the appropriate range of the value of 2h/(ϕ−d) can be said to be 0.5≦2h/(ϕ−d)≦2.5 (or 0.5×(ϕ−d)/2≦h≦2.5×(ϕ−d)/2). Further, taking into account variations in the above measurement results due to various factors, the optimum value of 2h/(ϕ−d) is considered to be 1, the central value of the above-mentioned appropriate range.

Figures 12, 13:
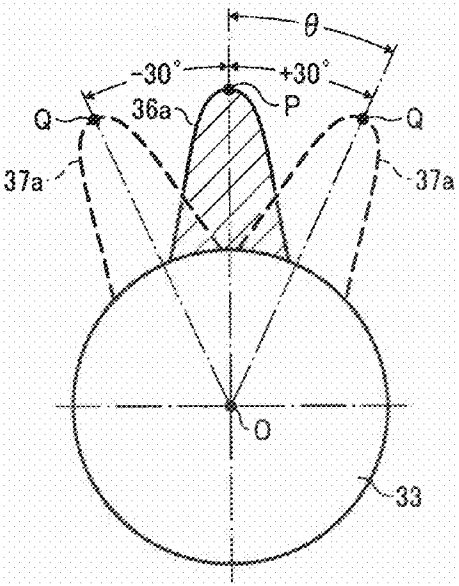
FIG. 12 is a diagram of the above-mentioned transport screw as seen from the axial direction.
FIG. 13 is a diagram showing determination results of toner transport force orthogonal to the axial direction of the screw at various setting angles.

In FIG. 6, the respective ends 36*a*, 37*a* of the first blade part 36 and second blade part 37, which spiral in opposite directions from one another, are arranged in the same locations in the circumferential direction of the rotating shaft 33. Or, as shown in FIG. 12, the respective ends 36*a*, 37*a* of the first blade part 36 and second blade part 37 can also be arranged at different locations in the circumferential direction of the rotating shaft 33. However, if the end 36*a* of the first blade part 36 and the end 37*a* of the second blade part 37 are shifted too much from one another in the circumferential direction, the toner being transported to the spiral direction reversal part by the first blade part 36 and the second blade part 37 will be displaced, making it difficult for the two flows of toner to collide with one another. Consequently, there is the fear that the toner transport force orthogonal to the axial direction of the transport screw (toner push-up force) will decrease.

Accordingly, the inventors conducted tests to determine the toner transport force orthogonal to the axial direction of the transport screw (toner push-up force) for respective amounts of circumferential displacement of the ends 36*a*, 37*a* of the first blade part 36 and second blade part 37. The same testing device as that shown in FIG. 8 was used for this test. Here, the above-mentioned "respective amounts of circumferential displacement of the ends 36*a*, 37*a* of the first blade part 36 and second blade part 37" refers to the phase difference in the circumferential direction of the rotating shaft 33 of the apex P of the one end 36*a* and the apex Q of the other end 37*a*. Further, this phase difference is treated as the angle θ formed between two straight lines connecting the center O of the rotating shaft 33 with the apexes P, Q of the respective ends 36*a*, 37*a*. Then, the differential results of the toner transport force orthogonal to the axial direction of the screw (toner push-up force) for the angles θ set for respective values are shown in FIG. 13.

In FIG. 13, ○ is used when the toner push-up height is the highest, and, by contrast, × is used when this toner push-up height is the lowest (Refer to FIG. 8). The Δ is used when the toner push-up height is a height between the above-mentioned highest and lowest heights. Based on these results, it is preferable to set $-30° \leqq \theta \leqq +30°$ to obtain good toner transport force orthogonal to the axial direction of the screw (toner push-up force). That is, it is preferable that the apex P of the one above-mentioned end 36*a* be set within a phase range of 300 in the circumferential direction of the rotating shaft relative to the apex Q of the other above-mentioned end 37*a*.

Figure 14:
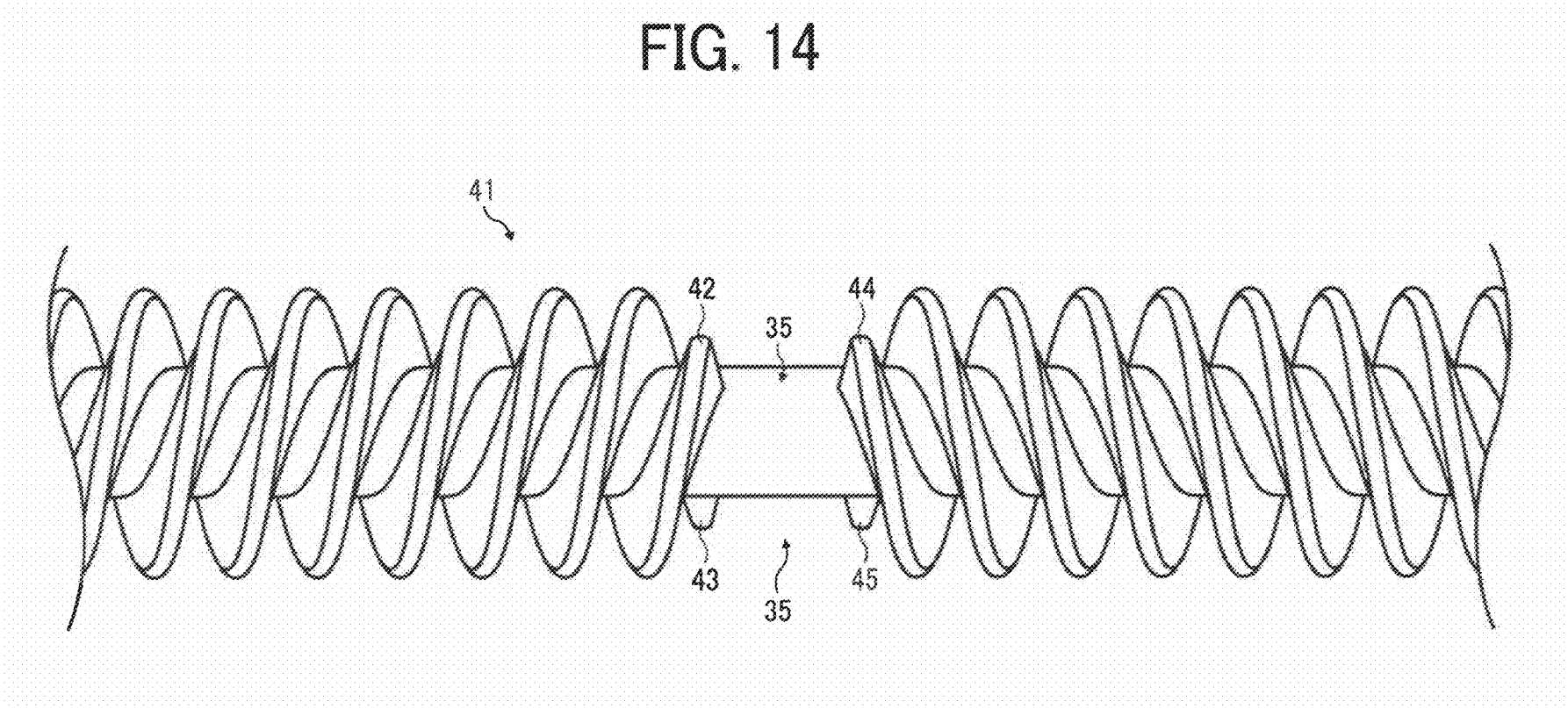
FIG. 14 is a diagram showing an embodiment that uses the constitution of the present invention in a double-blade transport screw.

FIG. 14 shows an embodiment that applies the passage 35 described hereinabove to a toner transport screw 41 on which double blades are formed. In this toner transport screw 41, the direction of spiral of the double blade parts 42, 43 on the left side is the reverse of the direction of spiral of the double blade parts 44, 45 of the right side relative to the middle part of the figure in the right-left direction. Then, the ends of the right-side double blade parts 42, 43 are respectively separated from the opposing ends of the left-side double blade parts 44, 45, and passages 35 are respectively formed between the opposing ends. Further, the constitution of the present invention can be similarly applied to a transport screw on which triple or more blades have been formed (drawing omitted).

Figure 15:
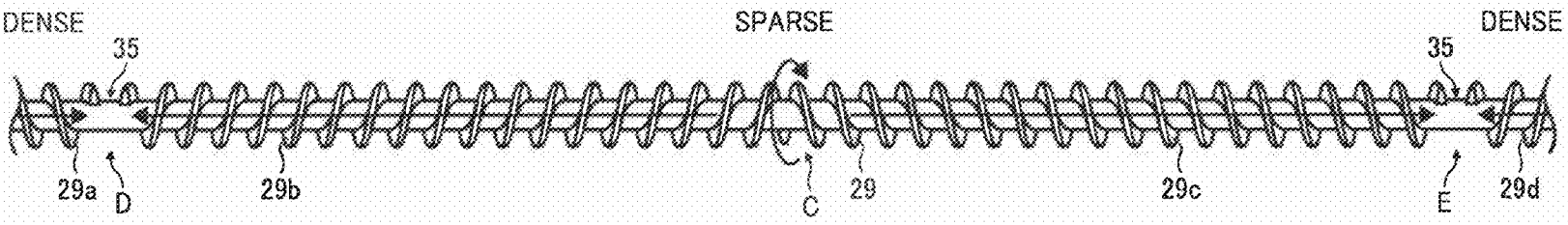
FIG. 15 is a diagram for illustrating the transporting operation of the transport screw of the present invention.

FIG. 15 is a diagram showing only the toner transport screw 29 of FIG. 4. Rotating the toner transport screw 29 in the direction of the arrow in the figure transports the toner from the spiral direction reversal part C in the middle part of the toner transport screw 29 to the spiral direction reversal parts D, E at both ends using the long blade parts 29*b* and 29*c*, which are disposed from the middle part in the axial direction. Further, toner is transported to the spiral direction reversal parts D, E at both ends by the short blade parts 29*a* and 29*d*, which are disposed at both ends in the axial direction. That is, since the toner is transported toward both ends of the toner transport screw 29, the toner density at the middle spiral direction reversal part C is sparse (low density). Conversely, since the toner is transported from both sides, the toner density at the spiral direction reversal parts D, E at the ends is dense (high density).

In a spiral direction reversal part in which a V-shaped groove is formed as in the prior art, the toner density constitutes a dense state, and toner readily builds up inside the above-mentioned groove. However, in the transport screw of the present invention, since respective passages 35 are formed in the spiral direction reversal parts D, E, where toner density constitutes a dense state, the toner can escape in the circumferential direction (the direction of arrow Z in FIG. 6) by way of the passages 35. Consequently, toner fluidity can be ensured in the spiral direction reversal parts D, E, making it possible to curb toner clumping in the spiral direction reversal parts D, E. Accordingly, it is possible to prevent problems, such as a deterioration of the transport function and the clogging of the transport route caused by toner clumping and accumulation.

Figure 16:
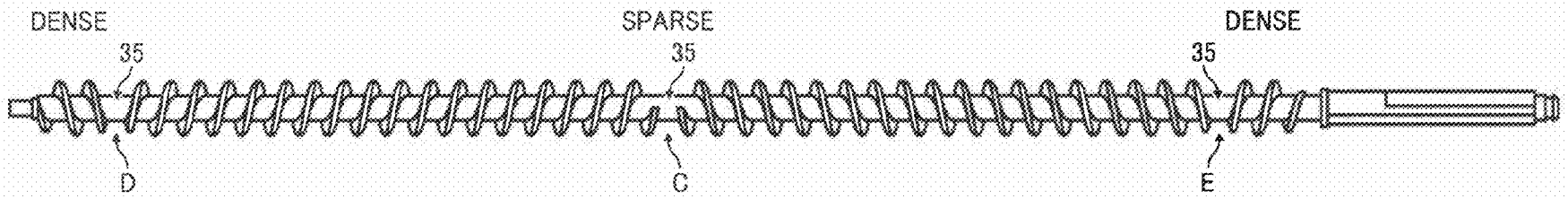
FIGS. 16 through 19 are front views showing respective other embodiments of the above-mentioned transport screw.

Further, as shown in FIG. 16, a passage 35 can also be formed at the spiral direction reversal part C in the middle part where toner density constitutes a sparse state. Generally speaking, toner is less likely to clump in a place where toner density is sparse than in a place where toner density is dense, and toner clumping can be reliably prevented by forming a passage 35. Further, in a case in which the present invention is constituted such that the toner transport screw 29 can be rotated in the forward and reverse directions by a not-shown drive-force transfer device, it is also possible to alleviate toner clumping by rotating the toner transport screw 29 in reverse.

Figure 17:
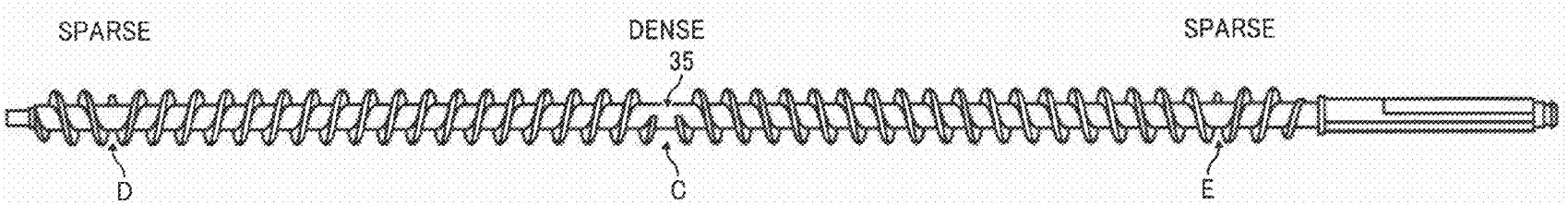

FIG. 17 is an embodiment in which toner density is dense at the spiral direction reversal part C of the middle part of the toner transport screw, and toner density is sparse at the spiral direction reversal parts D, E at the two ends. In this embodiment, forming a passage 35 in the middle-part spiral direction reversal part C, where toner density is dense, makes it possible to effectively prevent toner clumping.

Figure 18:
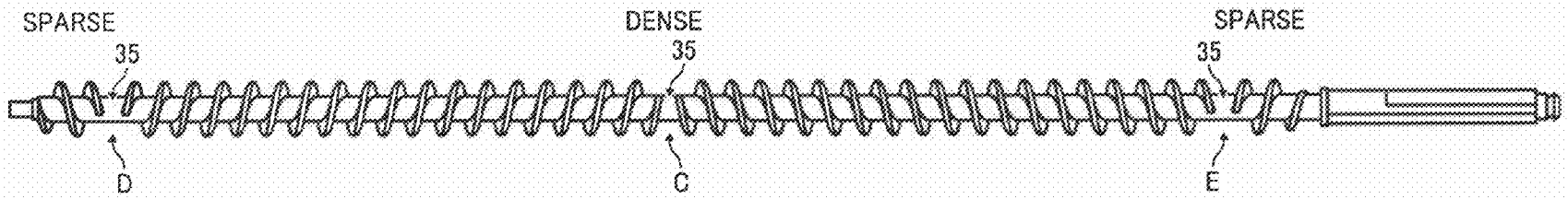

Further, as shown in FIG. 18, passages 35 can also be formed at the spiral direction reversal parts D, E at both ends, where toner density is sparse.

Figure 19:
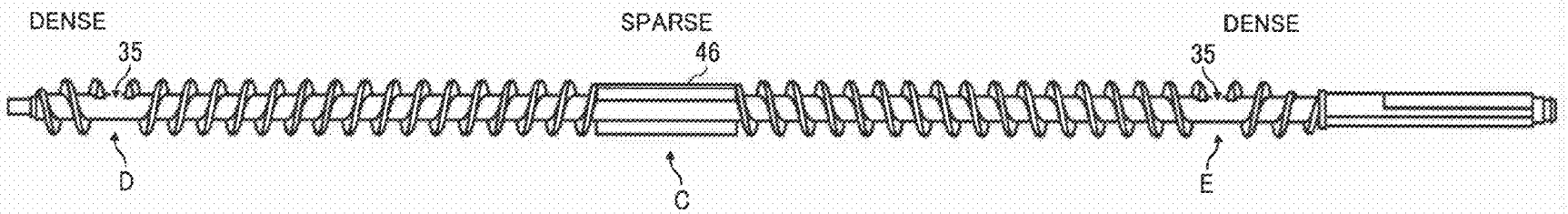

Further, as shown in FIG. 19, it is also possible to dispose a flat blade 46 at the spiral direction reversal part C of the middle part, where toner density is sparse.

The embodiments shown in FIGS. 16 through 19 hereinabove each had blades that were formed singly, but a shape that has a plurality of blades, either double blades or triple blades, is also possible.

Further, from the standpoint of making it possible to form a complex shape inexpensively, it is preferable that the material of the above-described toner transport screw 29 be a thermoplastic resin, such as either a polystyrene (PS) or polycarbonate (PC), or an acrylonitrile-butadiene-styrene copolymer resin (ABS resin).

The present invention described hereinabove has the following characteristic features.

(1) When the powder transport screw is rotated, the powder is able to relatively circumferentially pass through the blades via a passage in the spiral direction reversal part. Consequently, the fluidity of the toner can be ensured, making it possible to prevent the powder from clumping.

(2) Disposing a first blade part and a second blade part completely separate from one another in the axial direction, and forming a passage between the ends of these separated first blade part and second blade part makes it possible to ensure a passage with a large powder transit region. Consequently, the fluidity of the powder can be greatly improved, and powder clumping can be effectively curbed.

(3) Powder density becomes higher at a spiral direction reversal part where the powder is carried in from both the first blade part and the second blade part, making the powder more apt to clump. Forming a passage, which allows for the passage of the powder, in the spiral direction reversal part where powder is apt to clump like this makes it possible to ensure powder fluidity and to effectively curb powder clumping.

(4) Setting the width corresponding to the axial direction of the passage to the above-mentioned lower limit value or higher makes it possible to give full play to the function that allows the powder to pass through the passage. Further, setting the above-mentioned width to the above-mentioned upper limit value or lower makes it possible to exhibit good powder transport capabilities orthogonal to the axial direction in the spiral direction reversal part.

(5) When the width corresponding to the axial direction of the above-mentioned passage is expressed as h and the diameter of the above-mentioned rotating shaft is expressed as d, making the setting such that $0.25\times d \leqq h \leqq 1.25\times d$ makes it possible the give full play to the function that allows the powder to pass through the passage. Further, it also enables the demonstration of good powder transport capabilities orthogonal to the axial direction at the spiral direction reversal part.

(6) When the width corresponding to the axial direction of the above-mentioned passage is expressed as h, the diameter of the above-mentioned rotating shaft is expressed as d, and the outside diameter of the above-mentioned blade is expressed as p, making the setting such that $0.5\times(\phi-d)/2 \leqq h \leqq 2.5\times(\phi-d)/2$ makes it possible the give full play to the function that allows the powder to pass through the passage. Further, it also enables the demonstration of good powder transport capabilities orthogonal to the axial direction at the spiral direction reversal part.

(7) Allocating the phase difference between the apex of the end of the first blade part and the apex of the end of the second blade part as described hereinabove makes it possible to demonstrate good powder transport capabilities orthogonal to the axial direction at the spiral direction reversal part.

(8) Respectively disposing the above-mentioned spiral direction reversal parts at both ends of the above-mentioned rotating shaft, and forming the above-mentioned passage in at least one of these spiral direction reversal parts makes it possible to ensure the fluidity of the powder and to curb powder clumping in at least one of the spiral direction reversal parts disposed at both ends of the rotating shaft.

(9) Disposing the above-mentioned spiral direction reversal part in the middle part of the above-mentioned rotating shaft, and forming the above-mentioned passage in this spiral direction reversal part makes it possible to ensure the fluidity of the powder and to curb powder clumping in the spiral direction reversal part disposed in the middle part of the rotating shaft.

(10) Constituting both the above-mentioned rotating shaft and the above-mentioned blade from a thermoplastic resin makes it possible to inexpensively form a powder transport screw having a complex shape.

(11) A toner can be used as the powder that is transported by the powder transport screw.

(12) Applying the powder transport screw of the present invention to the toner transport screw of the development part makes it possible to carry out the transport of toner inside the development part smoothly and stably.

(13) Rotating the powder transport screw inside the development part causes the toner inside the development part to enter into the spiral direction reversal part of the powder transport screw. Then, the toner that has entered accumulates in the spiral direction reversal part and is pushed out to the toner hopper from the return opening. The passage formed in the above-mentioned spiral direction reversal part where the toner density becomes high makes it possible to ensure the fluidity of the toner and to curb toner clumping in this spiral direction reversal part. Consequently, the transport of toner inside the development part can be carried out smoothly and stably.

(14) Disposing toner feeding means for transporting toner from the above-mentioned return opening to the above-mentioned supply opening makes it possible to circulate the toner between the toner hopper and the development part.

(15) Applying the powder transport screw of the present invention to the toner transport screw of a process unit makes it possible for the transport of toner inside the process unit to be carried out smoothly and stably.

(16) Applying the powder transport screw of the present invention to the toner transport screw of an image-forming apparatus makes it possible for the transport of toner inside the image-forming apparatus to be carried out smoothly and stably.

According to the powder transport screw of the present invention described hereinabove, it is possible to ensure the fluidity of a powder and to curb powder clumping in a spiral direction reversal part. Consequently, the effect is that it becomes possible to prevent problems, such as the deterioration of the transport function and the clogging of the transport route that occur due to the clumping and build up of the powder.

Further, the same effects as above can also be exhibited in a development device, process unit and image-forming apparatus that comprise the above-mentioned powder transport screw.

Various modifications will become possible for those skilled in the art after receiving the teachings of the present disclosure without departing from the scope thereof. For example, the present invention described hereinabove was explained by giving an example of a case in which a passage for allowing the toner to pass though in the circumferential direction was used in the toner transport screw disposed inside the development part, but it is also possible to form the above-mentioned passage in the toner feeding screw disposed inside the toner hopper. Further, the transport screw of the present invention is not limited to transporting toner, and can transport a powder other than a toner as well.

What is claimed is:

1. A powder transport screw, comprising:

a rotating shaft;

helical blades comprising a first blade part and a second blade part disposed on a circumference of the rotating shaft, a spiral of the first blade part and the second blade part being in opposite directions;

at least one spiral direction reversal part formed on the rotating shaft in between respective ends of the first blade part and the second blade part; and a passage formed in the spiral direction reversal part around the circumference of the rotating shaft between respective ends of the first blade part and the second blade part, the passage allowing a powder to pass through a width of the passage formed in an axial direction of the rotating shaft, wherein the first blade part and the second blade part do not overlap with each other in the circumferential direction of the rotating shaft at the passage to allow the powder to pass there between.

2. The powder transport screw according to claim 1, wherein the first blade part and the second blade part are disposed completely separated from each other in the axial direction of the rotating shaft.

3. The powder transport screw according to claim 1, wherein a rotation of the rotating shaft carries the powder into the spiral direction reversal part from both the first blade part and the second blade part.

4. The powder transport screw according to claim 3, wherein a lower limit value of an axial-direction width of the passage is 1 mm, and an upper limit value of the passage width is 5 mm.

5. The powder transport screw according to claim 3, wherein when an axial-direction width of the passage is expressed as h and a diameter of the rotating shaft is expressed as d, then the relation $0.25\times d \leqq h \leqq 1.25\times d$ is satisfied.

6. The powder transport screw according to claim 3, wherein when an axial-direction width of the passage is expressed as h, a diameter of the rotating shaft is expressed as d, and an outside diameter of the blade is expressed as $\phi$, then the relation $0.5\times(\phi-d)/2 \leqq h \leqq 2.5\times(\phi-d)/2$ is satisfied.

7. The powder transport screw according to claim 3, wherein in a state in which the respective ends of the first blade part and the second blade part, which are separated with the passage there between, are viewed from an axial direction of the rotating shaft, when a phase difference in the circumferential direction of the rotating shaft between the apex of one of the ends and the apex of the other of the ends is expressed as $\theta$, then the relation $-30° \leqq \theta \leqq +30°$ is satisfied.

8. The powder transport screw according to claim 1, wherein spiral direction reversal parts are disposed at both ends of the rotating shaft, and the passage is formed in at least one of the spiral direction reversal parts.

9. The powder transport screw according to claim 1, wherein the spiral direction reversal part is disposed in a middle part of the rotating shaft.

10. The powder transport screw according to claim 1, wherein the rotating shaft and the blade are both made from a thermoplastic resin.

11. The powder transport screw according to claim 1, wherein a toner is used as the powder.

12. The powder transport screw according to claim 3, wherein respective ends of the first blade part and the second blade part are arranged in the same location on a circumference of the rotating shaft.

13. The powder transport screw according to claim 1, wherein the screw includes three spiral direction reversal parts.

14. A development device, comprising:

a development part;

a toner hopper for holding a toner supplied to the development part; and a toner transport screw disposed inside the development part, the toner transport screw comprising:

a rotating shaft;

helical blades comprising a first blade part and a second blade part disposed on a circumference of the rotating shaft, a spiral of the first blade part and the second blade part being in opposite directions;

at least one spiral direction reversal part formed on the rotating shaft in between respective ends of the first blade part and the second blade part; and a passage formed in the spiral direction reversal part around the circumference of the rotating shaft between respective ends of the first blade part and the second blade part, the passage allowing a powder to pass through a width of the passage formed in an axial direction of the rotating shaft, wherein the first blade part and the second blade part do not overlap with each other in the circumferential direction of the rotating shaft to allow the powder to pass there between without contacting the first and second blade parts.

15. The development device according to claim 14, wherein a partitioning member is disposed between the development part and the toner hopper, and a supply opening for supplying toner from the toner hopper to the development part and a return opening for returning the toner from the development part to the toner hopper are disposed in the partitioning member, and a spiral direction reversal part, into which toner is carried from both the first blade part and the second blade part, is disposed corresponding to the return opening, and the passage is formed in the spiral direction reversal part.

16. The development device according to claim 15, wherein toner feeding means for transporting toner from the return opening to the supply opening is disposed inside the toner hopper.

17. An image-forming apparatus that comprises a toner transport screw, the toner transport screw comprising:

a rotating shaft;

helical blades comprising a first blade part and a second blade part disposed on a circumference of the rotating shaft, a spiral of the first blade part and the second blade part being in opposite directions;

at least one spiral direction reversal part formed on the rotating shaft in between respective ends of the first blade part and the second blade part; and a passage formed in the spiral direction reversal part around the circumference of the rotating shaft between respective ends of the first blade part and the second blade part, the passage allowing a powder to pass through a width of the passage formed in an axial direction of the rotating shaft, wherein the first blade part and the second blade part do not overlap with each other in the circumferential direction of the rotating shaft at the passage to allow the powder to pass there between.

* * * * *